US010078309B2

(12) United States Patent
Capt et al.

(10) Patent No.: US 10,078,309 B2
(45) Date of Patent: Sep. 18, 2018

(54) MOON PHASE DISPLAY MECHANISM

(71) Applicant: Blancpain SA, Le Brassus (CH)

(72) Inventors: Edmond Capt, Le Brassus (CH); Julien Feyer, Vernier (CH); Julien Behra, Les Rousses (FR)

(73) Assignee: Blancpain SA, Le Brassus (CH)

( * ) Notice: Subject to any disclaimer, the term of this patent is extended or adjusted under 35 U.S.C. 154(b) by 0 days.

(21) Appl. No.: 15/614,858

(22) Filed: Jun. 6, 2017

(65) Prior Publication Data

US 2018/0004162 A1 Jan. 4, 2018

(30) Foreign Application Priority Data

Jul. 4, 2016 (EP) ..... 16177847

(51) Int. Cl.
*G04B 19/26* (2006.01)
*G04B 19/253* (2006.01)

(52) U.S. Cl.
CPC ..... *G04B 19/268* (2013.01); *G04B 19/253* (2013.01); *G04B 19/26* (2013.01)

(58) Field of Classification Search
CPC .... G04B 19/253; G04B 19/26; G04B 19/268; G04B 49/00
USPC ..... 368/15, 16, 18
See application file for complete search history.

(56) References Cited

U.S. PATENT DOCUMENTS 4,684,260 A * 8/1987 Jackle ..... G04B 19/268 368/16
4,881,213 A * 11/1989 Zaslawsky ..... G04B 19/268 368/15
6,885,614 B2 * 4/2005 Rey-Mermet ..... G04B 19/268 368/16
7,649,811 B2 * 1/2010 Courvoisier ..... G04B 19/268 368/18
2006/0221771 A1 10/2006 Zimmermann et al.

FOREIGN PATENT DOCUMENTS

EP 2 853 957 A1 4/2015

OTHER PUBLICATIONS

European Search Report dated Dec. 16, 2016 in European application 16177847.7, filed on Jul. 4, 2016 ( with English Translation of Categories Cited Documents).

* cited by examiner

*Primary Examiner* — Edwin A. Leon
*Assistant Examiner* — Jason Collins
(74) *Attorney, Agent, or Firm* — Oblon, McClelland, Maier & Neustadt, L.L.P.

(57) ABSTRACT

Moon phase display mechanism including an input pinion which makes three revolutions, or respectively two revolutions, in 24 hours, and drives a 19-tooth or respectively 29-tooth drive pinion, which drives a 59-tooth lower wheel bearing a moon disc with a two-colored depiction including a lighted area and at least one background sky area and also drives a 57-tooth or respectively 58-tooth, upper wheel, coaxial to this lower wheel and which makes one revolution per day and which includes a sky disc with a depiction of the sun, and an aperture opposite this sun, through which is visible one part of this moon disc illustrating the current appearance of the moon.

11 Claims, 6 Drawing Sheets

MOON PHASE DISPLAY MECHANISM

This application claims priority from European Patent Application No. EP16177847.7 filed on Jul. 4, 2016; the entire disclosure of which is incorporated herein by reference.

FIELD OF THE INVENTION

The invention concerns a moon phase display mechanism arranged to cooperate with a timepiece movement, and comprising an input pinion arranged to make three revolutions, or respectively two revolutions, in 24 hours.

The invention also concerns a timepiece display mechanism including such a moon phase display mechanism.

The invention also concerns a timepiece movement including such a moon phase display mechanism.

The invention also concerns a watch including such a movement.

The invention concerns the field of watch display mechanisms, in particular for mechanical watches with complications.

BACKGROUND OF THE INVENTION

The moon phase display is a valued function in watchmaking, which complicates the manufacture of the movement, and which soon occupies a large volume inside the case. It is not always easy to correct such a display.

EP Patent Application No 2853957A1 in the name of CHRISTOPHE CLARET discloses a moon phase display mechanism which includes two discs rotating at different speeds, one of which bears the depiction of the moon and the other includes several apertures, arranged to reveal the depiction of the moon on the first disc to indicate in series the moon phases of a lunation through one of the apertures, and which are separated by several moon covers, which are all simultaneously visible. The moon phases of the successive lunations are indicated through adjacent apertures.

US Patent Application No 2006/2217771 in the name of ZIMMERMANN discloses a moon phase mechanism which includes a moon disc secured in a concentric manner on a moon display disc, wherein the moon disc is secured such that the moon disc rotates with respect to the moon display disc during the normal activity of the mechanism, The moon display disc is in a stationary position during the normal activity of the device, and is arranged to move only for manual display modifications.

SUMMARY OF THE INVENTION

The invention proposes to produce a moon phase display mechanism for a watch, which is simple and economical, with very few components and is not complex to produce.

To this end, the invention concerns a moon phase display mechanism according to claim 1.

The invention also concerns a timepiece display mechanism including such a moon phase display mechanism.

The invention also concerns a timepiece movement including such a moon phase display mechanism.

The invention also concerns a watch including such a movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

The invention concerns a simple and economical moon phase display mechanism for a watch.

This mechanism is described below in two variants, which utilise the same general principle, but with differences in the arrangement of the gear trains.

The invention concerns a moon phase display mechanism 10, which is arranged to cooperate with a timepiece movement 200, and includes an input pinion.

Figure 4:
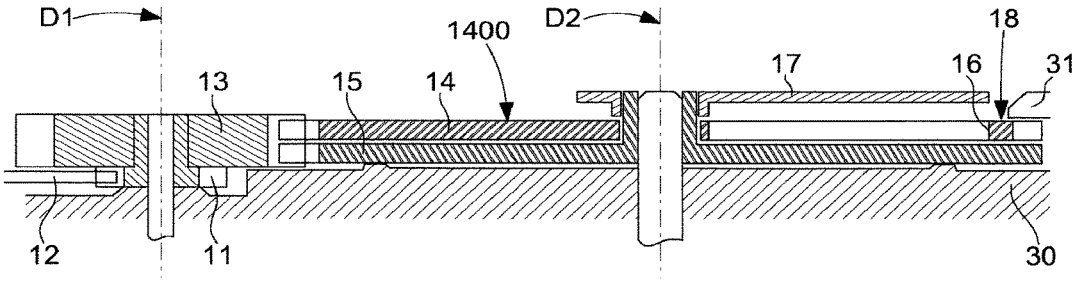
FIG. 4 shows a cross-sectional view, passing through the axes of a control wheel set and of the coaxial wheels, of a first variant of the mechanism according to the invention.

This input pinion is arranged to make:

in a first variant, three revolutions in 24 hours, referenced 11 in FIG. 4, or respectively, in a second variant, two revolutions in 24 hours.

Figure 11:
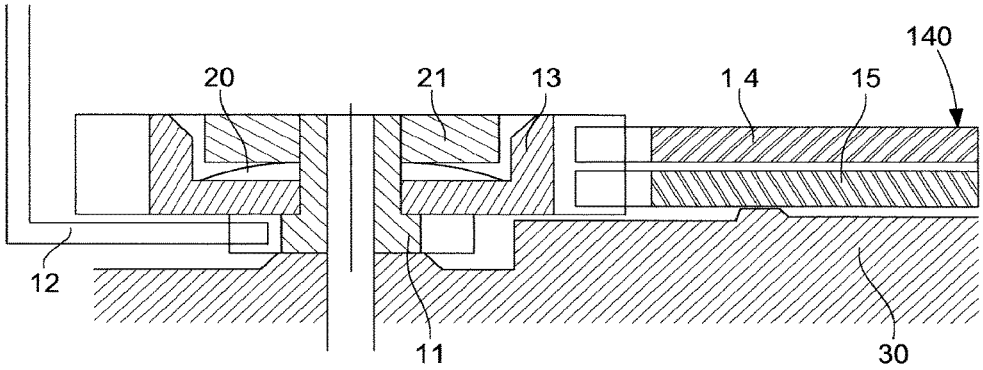
FIG. 11 shows a cross-sectional view, passing through the axes of a control wheel set and of the coaxial wheels, of a friction mechanism for correcting the moon phase display, applicable to the first variant or to the second variant of the invention.
Figure 12:
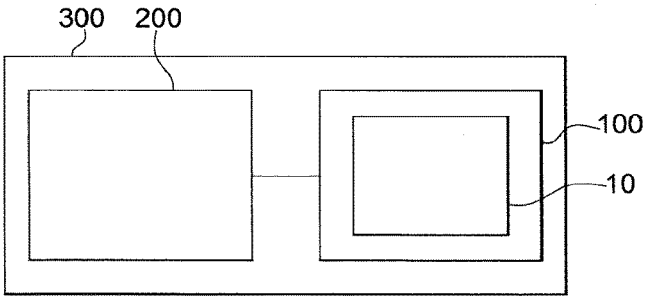
FIG. 12 is a block diagram representing a watch including a timepiece movement comprising a timepiece display mechanism including such a moon phase display mechanism.
Figure 8:
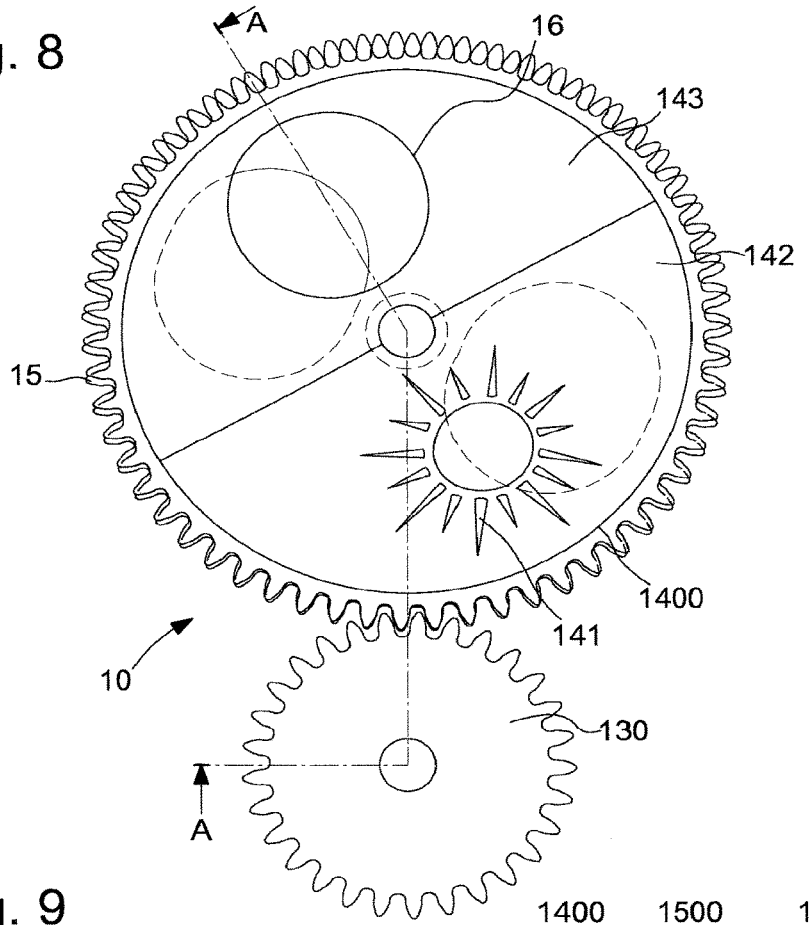
FIG. 8 shows a schematic, partial, front view of a moon phase display mechanism according to a second variant of the invention.
Figure 9:
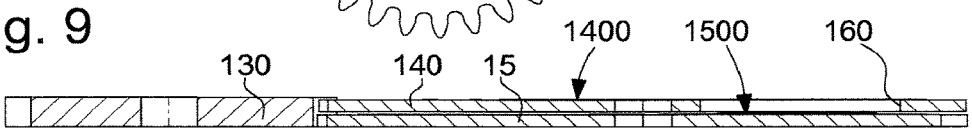
FIG. 9 shows, in a similar manner to FIG. 6, the mechanism of FIG. 8.

According to the invention, the input pinion drives at least one drive pinion, either directly, or via a friction means 20, as in the case of the FIG. 11 variant, or via another wheel set or gear train:

in the first variant, the input pinion drives at least one 19-tooth drive pinion, referenced 13 in FIG. 4;

in the second variant, the input pinion drives at least one 29-tooth drive pinion, referenced 130 in FIG. 8;

The drive pinion, referenced 13 or 130 depending on the variant, drives an upper wheel:

in the first variant, drive pinion 13 drives a 57-tooth upper wheel, referenced 14 in FIG. 4, in the second variant, drive pinion 130 drives a 58-tooth upper wheel, referenced 140 in FIG. 9.

This upper wheel makes one revolution per day in each of the variants.

The upper wheel includes, on the user's side, a sky disc 1400, with a depiction of the sky and of an off-centre sun 141, and which includes an off-centre aperture 16, substantially opposite sun 141, and through which is visible one part of lower wheel 15 illustrating the current appearance of the moon.

The 19-tooth drive pinion 13, or the 29-tooth drive pinion 130, is not necessarily the only drive pinion. This is a particular case.

Figure 1:
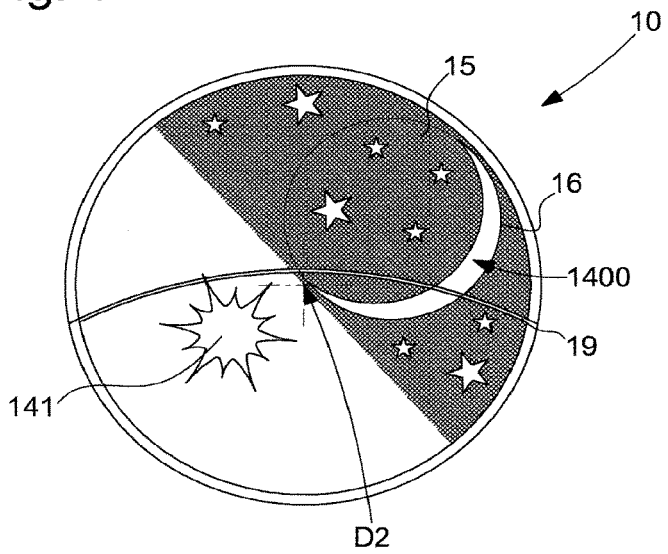
FIG. 1 shows a schematic, front view of a moon phase display mechanism according to the invention, with a moon disc visible through an aperture in a sky disc, these two discs being carried by coaxial wheels having different rotational speeds, and the sky disc forming a day/night display, visible behind a small bar symbolising the horizon.
Figure 2:
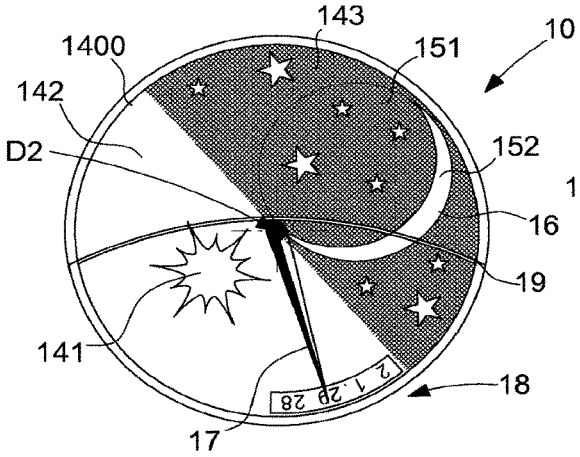
FIG. 2 shows, in a similar manner to FIG. 1, the same mechanism, completed by a moon age display, comprising a movable hand facing a partially represented graduated scale.

In a particular embodiment and as seen in FIGS. 1, 2 and 8, the depiction of the sky, on sky disc 1400, includes a first light or lighted portion 142 corresponding to the day, which bears the depiction of the sun 141, and includes a second dark or shaded portion corresponding to the night, which contains aperture 16 through which is visible the moon phase.

Figure 5:
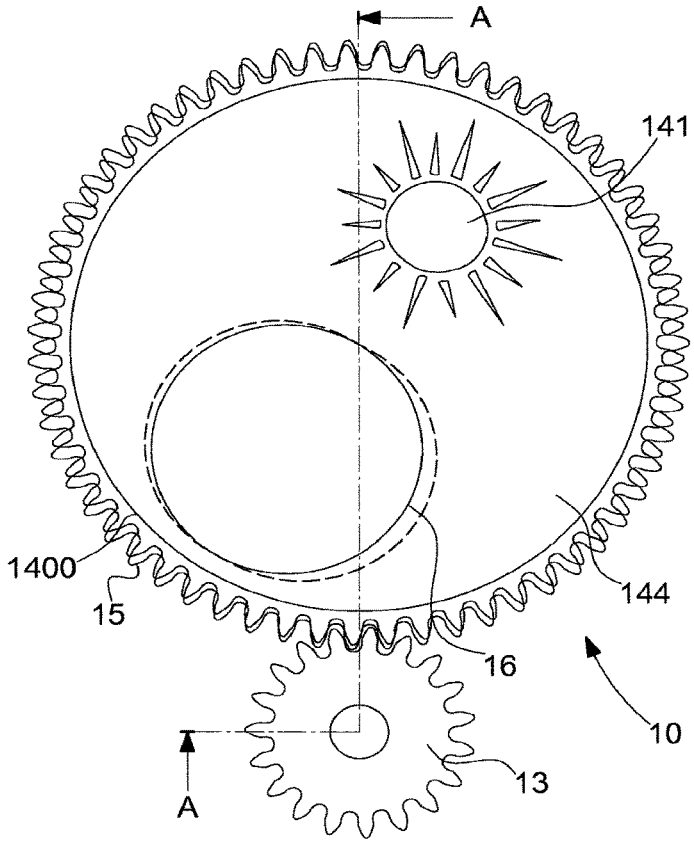
FIG. 5 shows a partial, schematic, front view of a moon phase display mechanism according to a first variant of the invention.
Figure 6:
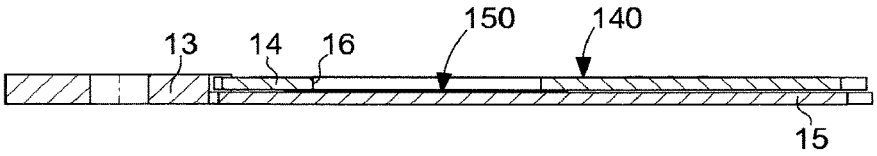
FIG. 6 shows, in a similar manner to FIG. 4, the mechanism of FIG. 5.

In FIG. 5, the depiction of the sky, on sky disc 1400, includes an image 144 which is gradually shaded (the shading is not illustrated in the Figure) from a light portion corresponding to the day in the depiction of the sun 141, to a dark portion corresponding to the night, at aperture 16.

To permit the display of the moon phase, the drive pinion designated 13 or 130 depending on the variant, drives a 59-tooth lower wheel 15.

Figure 3:
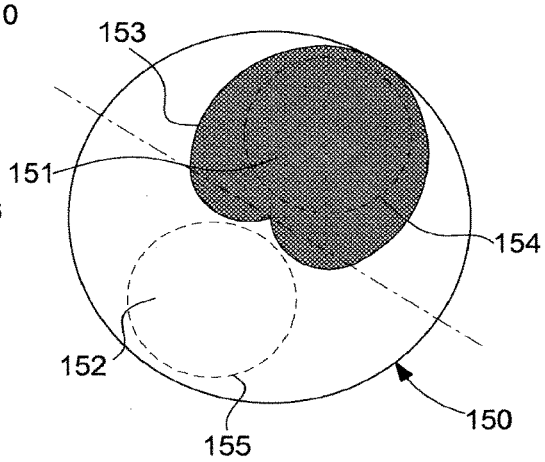
FIG. 3 shows, in a similar manner to FIG. 1, the moon disc of the same mechanism.
Figure 7:
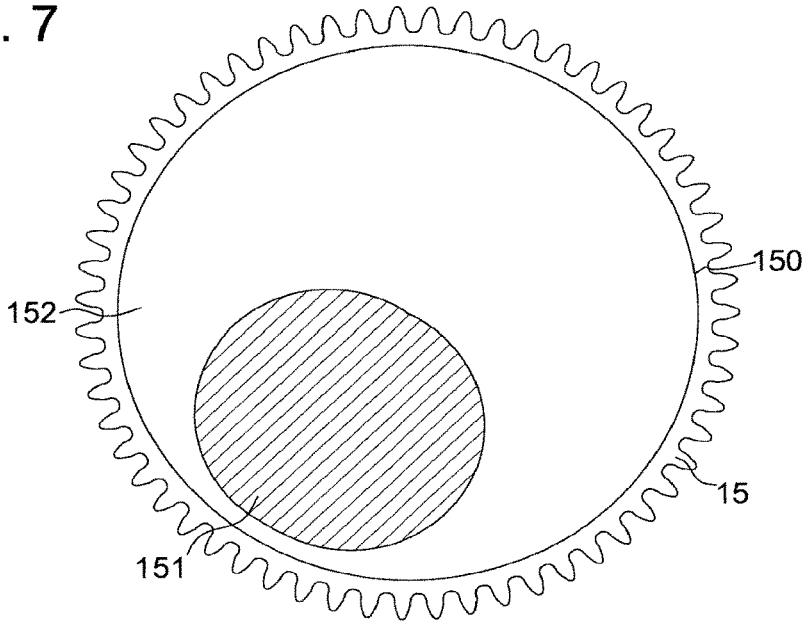
FIG. 7 shows, in a similar manner to FIG. 3, the moon disc of the mechanism of FIG. 5.
Figure 10:
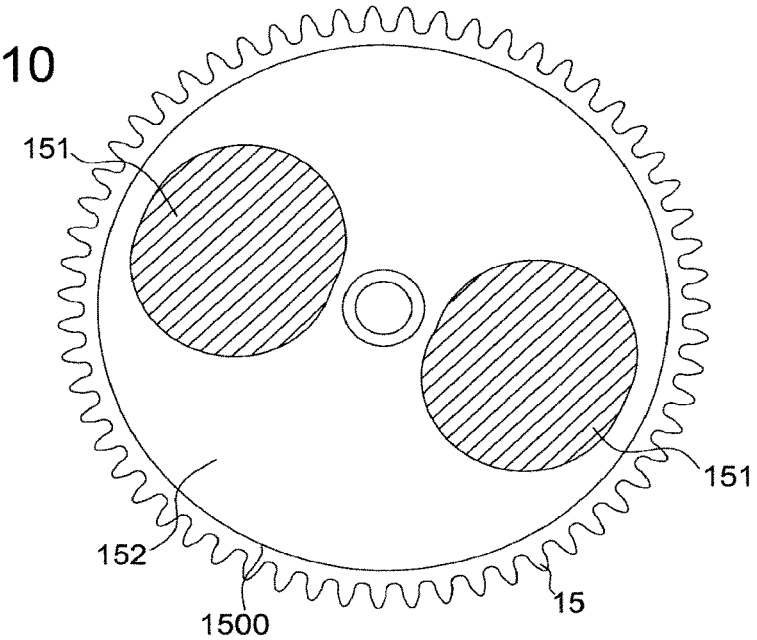
FIG. 10 shows, in a similar manner to FIG. 7, the moon disc of the mechanism of FIG. 8.
Figure 13:
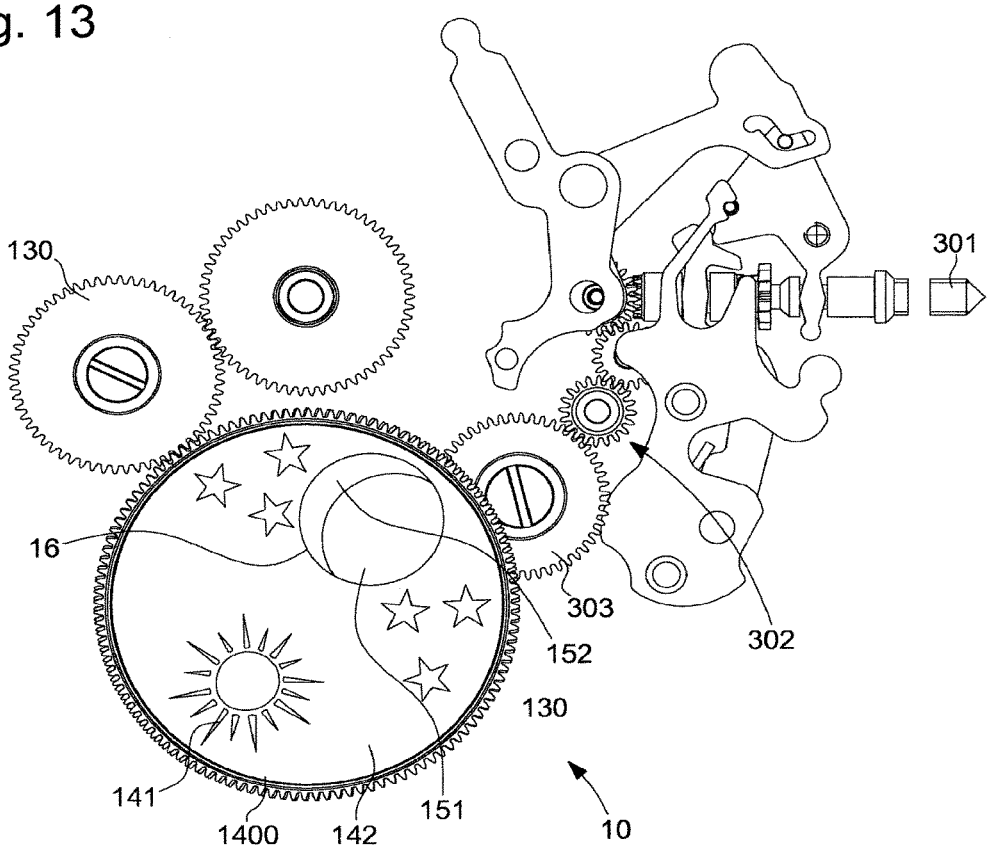
FIG. 13 represents a schematic front view of the moon phase display mechanism according to a second variant of the invention similar to that of FIG. 8, but in which the numbers of teeth have all been doubled.

This 59-tooth lower wheel 15, which is common to both variants, carries a moon disc, referenced 150 in the first variant as seen in FIG. 3 or 7, or 1500 in the second variant as seen in FIG. 10. Naturally, the moon disc can be placed on the lower wheel, or form a single component therewith, and may consist of enamelling, painting, silk printing, transfer printing or other means.

Moon disc 15 or 1500 comprises a two-coloured depiction comprising at least one lighted area 152 and at least one dark background sky area 151:

in the first variant, moon disc 150 comprises a lighted area 152 and a background sky area 151, lighted area 152 comprising an area 155 corresponding to the full moon display, and a background sky area 151 comprising an area corresponding to the new moon display, also called the black moon:

in the second variant, moon disc 1500 includes a lighted area 152 and two diametrically opposite background sky areas 151.

In the first variant, background sky area 151 is configured so that the duration of the new moon and of the full moon are approximately respected. In a particular embodiment, this background sky area 151 is delimited by a conchoid of circle or cardioid boundary, so that the whole depictions of the new moon and the full moon are each visible through aperture 16.

To make the moon appear complete, sky disc 1400 pivots on the outside. Otherwise, its axis could be concealed by the horizon line.

In the illustrated embodiments corresponding to a preferred embodiment of smaller dimensions, upper wheel 14 or 140, depending on the variant, is coaxial to lower wheel 15.

The first variant utilises a particular gear ratio 57-19-59 which makes it possible to achieve a moon phase of extreme simplicity, and which uses virtually no energy, since the mechanism is devoid of jumper springs and is in mesh directly on the hour wheel in a continuous movement.

Input pinion 11 meshes with hour wheel 12 of the timepiece movement and makes three revolutions in 24 hours.

$$Z=Zh/3.$$

Input pinion 11 carries 19-tooth drive pinion 13, which drives the two coaxial respectively 57 and 59-tooth wheels: 57-tooth upper wheel 14 and 59-tooth lower wheel 15.

In a particular non-limiting variant, input pinion 11 and drive pinion 13 are integral.

In another variant, input pinion 11 only carries drive pinion 13, which it drives indirectly, for example by means of a separate wheel set.

Upper wheel 14 includes 57 teeth and thus makes:

$$3\times{}^{19}/_{57}=1 \text{ revolution in 24 hours.}$$

Lower wheel 15 includes 59 teeth and makes:

$$3\times{}^{19}/_{59}=0.966101695 \text{ revolutions in 24 hours.}$$

$$\Delta=1/(1-0.966101695)=29.5,$$

which means that lower wheel 15 will make one revolution in the opposite direction with respect to upper wheel 14 in 29.5 days, namely the mean duration of the lunar month.

Mechanism 10 includes a fixed portion formed by a plate 30 or a bar 31, to which is secured a small bar 19 in superposition on sky disc 1400 and symbolising the horizon line, on either side of which the depiction of the sun 141 can move during the rotation of upper wheel 14 or 140, as seen in FIGS. 1 and 2. Sky disc 1400 with the moon and sun rotates at the rate of the day and of the night.

In the particular embodiment of FIG. 2, lower wheel 15 is attached, for example via a hand pipe, to a display member or a hand 17 for displaying the age of the moon on a graduation 18 comprised in sky disc 1400.

There are various possible choices of gear train to achieve this first variant.

In a first option, 19-tooth drive pinion 13 is the only drive pinion, and meshes simultaneously with 57-tooth upper wheel 14, and with 59-tooth lower wheel 15.

In the preferred embodiment illustrated by the Figures, upper wheel 14 and lower wheel 15 are coaxial. They do not have any direct drive means between them, and are free to rotate with respect to each other; they can therefore, depending upon the drive means applied thereto, rotate in the same direction or in opposite directions.

It is therefore a question of determining the best possible compromise for a single 19-tooth drive pinion 13, which simultaneously meshes with 57-tooth upper wheel 14, and with 59-tooth lower wheel 15, in each case as closely as possible to the pitch circle to optimise contact and limit wear. Naturally, meshing then necessarily occurs slightly above the pitch circle with one of the wheels, and a little below the pitch circle with the other, in a compromise that allows this assembly with a small number of parts, and a very small thickness, and which is also possible because the wheels always rotate in the same direction.

For a module m=0.17 (Blancpain 67 calibre) suitable for a moon diameter of 9.0 mm, the calculation of the theoretical distance of centres in this first option gives the following values:

$$C59=0.17\times(59+19)/2=6.63$$

$$C57=0.17\times(57+19)/2=6.46$$

With the mean value Cm 6.545, meshing is evenly distributed on either side of the pitch circle of drive pinion 13, with a very low distance:

$$\Delta 57=-0.085$$

$$\Delta 59=+0.085,$$

Dpm=0.17×58=9.86 (for cutting 57-tooth upper wheel 14, and 59-tooth lower wheel 15).

In a second option, the drive pinion is doubled, with: m57=0.1722 and m59=0.1678, the meshing of upper wheel 14 and lower wheel 15 then occurs on the pitch circle associated with the drive pinion, which is less expensive to produce if it is in one piece, and may require slightly greater thickness dimensions, in order to ensure the retraction of each of the cutting tools. This drawback disappears with the use of two superposed pinions, each with the right module and made to rotate integrally via wedged keying, bonding or similar.

In yet another option, upper wheel 14 and lower wheel 15 are not strictly coaxial, one having a radial play with respect to the other; correction of this play then requires an elastic return towards the drive pinion via a jumper spring or similar, which then induces energy consumption, which the first option or second option avoid.

In short, in this first variant of the moon phase display mechanism 10, input pinion 11 is arranged to make three revolutions in 24 hours, drive pinion 13 has 19 teeth, upper wheel 14 has 57 teeth, and, on moon disc 150, the two-coloured depiction includes a lighted area 152 and a background sky area 151, delimited by a conchoid of circle or cardioid boundary 153 and so that complete representations of the new moon and of the full moon are each visible through aperture 16.

The second variant utilises a different gear ratio 58-29-59.

Input pinion 110 meshes with hour wheel 12 of the timepiece movement and makes two revolutions in 24 hours. This input pinion 110 carries 29-tooth drive pinion 130, which drives 58-tooth upper wheel 140, as seen in FIG. 9, and 59-tooth lower wheel 15.

Upper wheel 140 includes 58 teeth and thus makes:

$$(2\times29)/58=1 \text{ revolution in 24 hours.}$$

Lower wheel 15 has 59 teeth and its moon disc 1500 includes two background sky areas 151. Lower wheel 15, since it has two background sky areas, makes:

$$2\times(1/2)\times(29/59)=0.491525424 \text{ revolution in 24 hours.}$$

$$\Delta=1/(1-0.491525424)=59, \text{ in the opposite direction.}$$

As 29-tooth drive pinion 130 makes one revolution in 12 hours, it is possible to envisage placing it directly on the hour wheel of the movement, but a reverser must be added to ensure the correct direction of rotation for the day/night display, and an uncoupling means is also required between the hour wheel and the moon drive device.

In short, in this second variant of moon phase display mechanism 10, input pinion 11 is arranged to make two revolutions in 24 hours, drive pinion 130 includes 29 teeth, the two-coloured depiction of moon disc 1500 includes a lighted area 152 and two background sky areas 151, and upper wheel 14 includes 58 teeth.

FIGS. 13 to 16 illustrate another embodiment of the second variant, wherein all the numbers of teeth are doubled, which does not change the gear ratios, makes it possible to reduce play.

Figure 14:
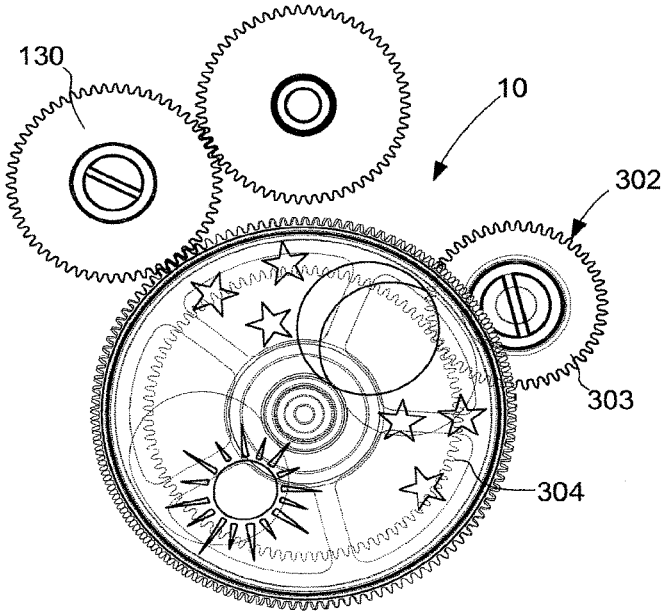
FIG. 14 illustrates the details of the gear train that are not visible in FIG. 13.
Figure 15:
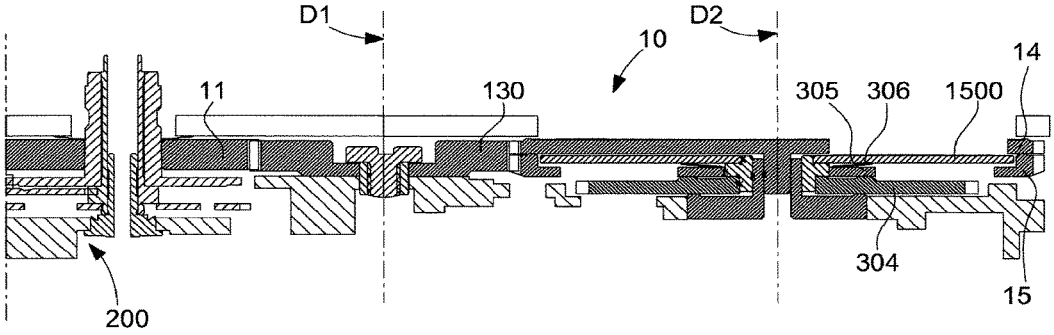
FIGS. 15 and 16 represent, in cross-section, respectively from the drive device to the moon phase display, and from a corrector stem to the moon phase display, the mechanism illustrated in FIGS. 13 and 14.
Figure 16:
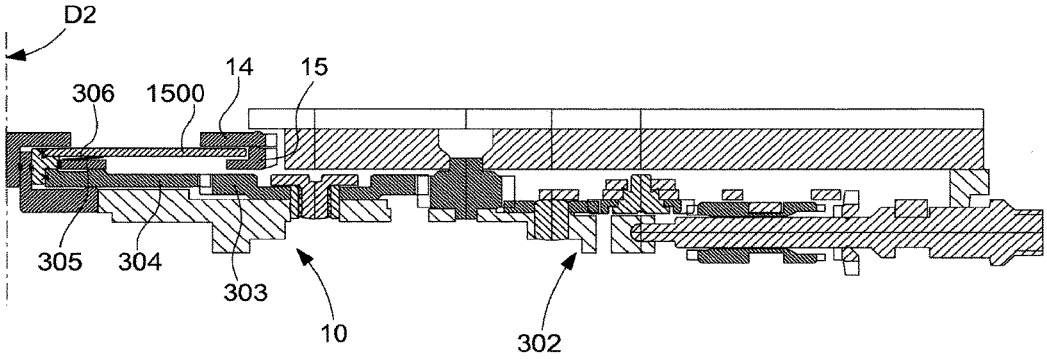

FIG. 11 illustrates a simple means of producing a moon phase corrector: the correction may be achieved by inserting a friction means 20 on the connecting wheel set between input pinion 11, connected to hour wheel 12, onto which a retaining ring 21 is pressed, and drive pinion 13 controlling the lunations. It is possible to envisage correcting the moon from position T2 of winding stem 301 of a watch 300, by means of an intermediate train 302, or by a corrector lever acting, in particular in a first mode, on drive pinion 13, drive pinion 13 then being driven by input pinion 11, via a friction means 20, to allow a correction to be made from a control stem via an intermediate train, or from a corrector lever acting on drive pinion 13; it is clear that, in this first mode, the sky disc and moon disc are corrected together. FIG. 14 illustrates another correction mode, with a correction relating to the moon disc with respect to the sky disc: the last wheel 303 of an intermediate train 302 drives a wheel 304, which cooperates via a friction means comprising a ring 305 and an elastic washer 306, with moon disc 1500.

The invention also concerns a timepiece display mechanism including such a moon phase display mechanism 10.

The invention also concerns a timepiece movement 200 comprising such a moon phase display mechanism 10, and comprising an hour wheel 12 arranged either to drive input pinion 11 and to drive drive pinion 13 or 130, or to form input pinion 11 and both carry and drive the drive pinion, in which case drive pinion 13 drives upper wheel 14 indirectly through a reverser, in a manner known to those skilled in the art, and drive pinion 13 drives lower wheel 15 indirectly through an uncoupling means.

More particularly, this movement 200 includes a winding and corrector stem 301 and stem 301 is arranged to control correction of the moon phase via an intermediate train 302.

The invention also concerns a watch 300 including a movement 200 of this type.

What is claimed is:

1. A moon phase display mechanism arranged to cooperate with a timepiece movement, and comprising an input pinion arranged to make three revolutions, or respectively two revolutions, in 24 hours, wherein said input pinion carries and/or drives either directly, or via a friction means, at least one 19-tooth, or respectively 29-tooth, drive pinion, and wherein said drive pinion drives a 59-tooth lower wheel bearing a moon disc with a two-coloured depiction comprising a lighted area and one, or respectively two, background sky areas, and wherein said drive pinion drives a 57-tooth or respectively 58-tooth, upper wheel, coaxial to said lower wheel and which makes one revolution per day and which includes, on a side facing a user, a sky disc with a depiction of the sky and of an off-centre sun, and including an off-centre aperture substantially opposite said sun and through which one part of said moon disc is visible illustrating the current appearance of the moon.

2. The moon phase display mechanism according to claim 1, wherein said drive pinion is the only drive pinion and drives both said lower wheel and said upper wheel.

3. The moon phase display mechanism according to claim 2, wherein said drive pinion is driven by said input pinion via a friction means to allow a correction to be made from a control stem via an intermediate train, or from a corrector lever acting on said drive pinion.

4. The moon phase display mechanism according to claim 1, wherein said input pinion is arranged to make three revolutions in 24 hours, wherein said drive pinion includes 19 teeth, wherein said two-coloured depiction includes a lighted area and a background sky area, wherein said upper wheel includes 57 teeth, and wherein, on said moon disc, said two-coloured depiction of the moon and of the background sky includes a conchoid of a circle or cardioid boundary and so that complete depictions of the new moon and of the full moon are each visible through said aperture.

5. The moon phase display mechanism according to claim 1, wherein said input pinion is arranged to make two revolutions in 24 hours, wherein said drive pinion has 29 teeth, wherein said two-coloured depiction includes a lighted area and two background sky areas, and wherein said upper wheel includes 58 teeth.

6. The moon phase display mechanism according to claim 1, wherein said moon phase display mechanism includes a fixed part consisting of a plate or a bar, to which is attached a small bar in superposition on said sky disc and symbolising the horizon line on either side of which the depiction of said sun can move during rotation of said upper wheel.

7. The moon phase display mechanism according to claim 1, wherein said lower wheel is integral with a display member or with a hand for displaying the age of the moon on a graduation comprised in said sky disc.

8. A timepiece display mechanism including a moon phase display mechanism according to claim 1.

9. A timepiece movement comprising a moon phase display mechanism according to claim 1, and comprising an hour wheel arranged either to drive said input pinion and to drive said at least one drive pinion, or to form said input pinion and both carry and drive said at least one drive pinion, in which case said drive pinion drives said upper wheel indirectly through a reverser, and said drive pinion drives said lower wheel indirectly through an uncoupling means.

10. The timepiece movement according to claim 9 with a moon phase display mechanism, and comprising a winding and corrector stem, wherein said stem is arranged to control correction of the moon phase via an intermediate train.

11. A watch including a timepiece movement according to claim 9.

* * * * *